United States Patent [19]

Richards

[11] Patent Number: 4,533,182

[45] Date of Patent: Aug. 6, 1985

[54] PROCESS FOR PRODUCTION OF OIL AND GAS THROUGH HORIZONTAL DRAINHOLES FROM UNDERGROUND WORKINGS

[75] Inventor: Walter L. Richards, Huntington Beach, Calif.

[73] Assignee: Methane Drainage Ventures, Placentia, Calif.

[21] Appl. No.: 637,303

[22] Filed: Aug. 3, 1984

[51] Int. Cl.[3] ..... E21B 43/14; E21C 41/10

[52] U.S. Cl. ..... 299/2; 166/369; 299/11; 299/18

[58] Field of Search ..... 166/50, 369; 175/62; 299/2, 7, 11, 12, 18, 19

[56] References Cited

U.S. PATENT DOCUMENTS

| | | | |
|---|---|---|---|
| 50,902 | 11/1865 | Casamajor | 299/2 X |
| 50,903 | 11/1865 | Casamajor | 299/2 |
| 436,216 | 9/1890 | Copeland | 166/369 X |
| 963,787 | 7/1910 | Martin | 299/2 |
| 1,506,920 | 9/1924 | DeChambrier | 299/2 |
| 1,660,187 | 2/1928 | Ehrat | 166/50 |
| 1,812,305 | 6/1931 | Ranney | 299/2 |
| 4,089,374 | 5/1978 | Terry | 166/258 X |
| 4,160,481 | 7/1979 | Turk et al. | 299/2 X |
| 4,234,232 | 11/1980 | Smith et al. | 299/18 X |
| 4,265,485 | 5/1981 | Boxerman et al. | 299/2 |
| 4,410,216 | 10/1983 | Allen | 299/2 |
| 4,452,489 | 6/1984 | Richards | 299/2 |
| 4,458,945 | 7/1984 | Ayler et al. | 299/2 |

*Primary Examiner*—George A. Suchfield

*Attorney, Agent, or Firm*—Fowler, Lambert & Hackler

[57] ABSTRACT

A method for collecting oil from a plurality of spaced-apart oil-bearing subterranean formations includes the steps of drilling a shaft from the earth's surface to a depth sufficient to intersect a plurality of spaced-apart oil-bearing formations, excavating a working area at selected oil-bearing subterranean formations and thereafter drilling a plurality of generally horizontal boreholes from each of the working areas into the selected oil-bearing subterranean formations. Thereafter, oil collection troughs are excavated within each of the working areas to collect oil from the boreholes and conduct the collected oil into a sump from which the oil is raised to the earth's surface utilizing a single lift. During collection and raising of the oil from each of the spaced-apart oil-bearing subterranean formations, the shaft and working areas are sealed.

21 Claims, 2 Drawing Figures

PROCESS FOR PRODUCTION OF OIL AND GAS THROUGH HORIZONTAL DRAINHOLES FROM UNDERGROUND WORKINGS

BACKGROUND OF THE INVENTION

This invention relates generally to methods and apparatus for the recovery of oil and gas from underground formations, and more particularly to the recovery of oil from known oil depleted formations and geological formations having properties and characteristics not considered heretofore to be suitable for economic recovery of the oil.

Recovery of oil from underground formations necessarily requires some flow of the oil through the formation to reach a point where it is typically lifted by mechanical means to the earth's surface. It should be readily apparent that the flow rate of the oil, since it is viscous liquid, through the rock formation depends on many factors, which include the hydraulic head of the oil, the thickness and permeability of the formation as well as the density and viscosity of the oil therein.

Many methods have been developed to increase the recovery of oil from underground formations. Typically, these methods have been of the secondary recovery type and utilized only after the collection or production rate of oil falls below an economically acceptable level. Many of the methods have been based on increasing the proximity or exposure of the drainhole path to the petroleum within the oil-bearing formation.

For example, as far back as 1920, Ehrat, in U.S. Pat. No. 1,660,187, described a method of recovering oil and gas from one or more oil-bearing strata in which galleries were excavated underneath the strata and boreholes were drilled upwardly from the galleries into the oil-bearing strata. The galleries were connected to a shaft leading to the earth's surface and all of the boreholes lined with tubes for collecting the oil and gas and for conducting it to the earth's surface by a system of pumps and piping.

This method, however, did not utilize horizontal holes drilled within the oil-bearing strata for the recovery of oil. Horizontal holes are far more effective in the recovery of oil from oil-bearing strata because of the proximity of the drainhole path to the petroleum to be collected.

It is also apparent that a horizontal borehole within an oil-bearing formation is more efficient for collecting oil therefrom than vertical holes or taps, because, in general, more borehole exposure within the oil-bearing formation is possible with the horizontal holes.

Another factor in the economic feasibility in oil recovery methods is the amount and cost of maintaining the collection system established by the method.

For example, maintenance of the Ehrat system is expensive because of the number of tubes, valves and pipes necessary to conduct the oil and gas to the earth's surface. Since the Ehrat galleries are ventilated and personnel must be present to attend the system, additional expense is incurred such as continual safety inspections, mandated by the Bureau of Mines, during the operation of the recovery method.

Ranney recognized the advantages of horizontal drilling for oil within formations, in the June issue of The Petroleum Engineer, in 1939, in an article entitled, "The First Horizontal Oil Well," and in his U.S. Pat. Nos.

2,280,851 issued on Apr. 28, 1942, and 2,365,591 issued on Dec. 19, 1944.

Ranney noted that horizontal wells are far more effective than vertically drilled wells in sands such as the Alberta tar sands. With regard to recovering oil from the Alberta tar sands, Ranney noted that, "something more than the mere drilling of a horizontal well must be resorted to." Ranney thereafter teaches methods for delivering a reagent into oil-bearing formations under conditions to recover the oil disposed about horizontal drill holes.

Not envisioned by Ranney, was the use of horizontal holes in multiple oil-bearing strata to recover or collect oil or the economics of utilizing a plurality of spaced-apart oil-bearing formations in a sealed system to recover oil.

As is apparent in FIG. 2, and within the specification of U.S. Pat. No. 2,365,591, Ranney contemplated a complex valve and piping arrangement for the injection fluids and for the recovery of dissolved oil therefrom. All of this necessitated access to the underground equipment during production and, as hereinabove pointed out, in connection with Ehrat, such an accessible oil recovery system causes a less favorable economic operation of the oil collection system.

Horizontal boreholes were also used in the methods of Turk, described in U.S. Pat. No. 4,160,481 issued on July 10, 1979, and Allen in U.S. Pat. No. 4,257,460 issued on Mar. 21, 1981. Although these methods employed generally horizontal holes drilled into underground oil-bearing formations, they primarily were directed to creating oil-driving forces by the injection of steam and/or inert gas in order to force the oil from the stratum into the horizontal boreholes.

As pointed out in Turk, a number of generally horizontal boreholes may be drilled from a shaft in a radial-like manner into an oil-bearing formation, and these radial horizontal holes may be positioned at a slight upward angle relative to their respective shaft hole in order to accommodate gravity flow of the oil in the formation. The drilling of holes in this manner also facilitated the use of a leaching fluid, which is injected through a portion of each horizontal hole in order to leach the oil therefrom back into the shaft.

It certainly can be appreciated that this leaching operation, whether it be with a solvent, with steam or an inert gas, as described in Allen, requires a significant amount of underground piping and valves, in addition to costly ventilation of the working areas to enable workmen to enter into the shafts and working areas for the purpose of operating the system to recover oil.

Although work has been progressing since 1920 regarding methods of collecting oil and gas from underground formations and particularly from underground formations from which the easily recovered oil has been collected, there has yet to be developed an economical method, or process, for removing oil from known formations having a plurality of spaced-apart oil-bearing strata.

The present invention is directed to a process utilizing horizontal holes drilled in a plurality of spaced-apart subterranean oil-bearing formations.

All of the previous work with the drilling of horizontal holes in underground formations was done at a single level, without any of the researchers realizing the economy in drilling horizontal holes into a plurality of spaced-apart oil-bearing strata.

Further, it has not been recognized that the utilization of a plurality of horizontal holes drilled from a single vertical shaft into a plurality of underground oil-bearing formations can be used as a collection system itself without the need for an extensive and expensive underground piping and valves, which must be maintained and operated by personnel, the latter requiring ventilation throughout the shaft and working areas, which is expensive, adds to the expense, and requires constant safety inspections.

The present invention overcomes all of the problems confronting the prior investigators and provides for a method or process for collecting oil and gas from a plurality of spaced-apart underground oil-bearing formations by the utilization of horizontal holes in a sealed collection system.

SUMMARY OF THE INVENTION

A method for collecting oil from a plurality of spaced-apart oil-bearing subterranean formations, in accordance with the present invention, includes the steps of drilling a shaft from the earth's surface to a depth sufficient to intersect a plurality of spaced-apart oil-bearing subterranean formations, excavating a working area at selected oil-bearing subterranean formations with each of the working areas communicating with the shaft, drilling a plurality of generally horizontal boreholes from each of the working areas into the selected oil-bearing subterranean formations, collecting oil from the boreholes and conducting the oil through the working areas and thereafter through the shaft to the earth's surface.

To facilitate the drilling, or sinking, of a shaft from the earth's surface and the excavation of a working area at selected oil-bearing subterranean formations, without the flooding of the shaft and working area with oil and/or water, grout may be injected at selected oil-bearing subterranean formations to form a grout curtain. Thereafter, the working area at the selected oil-bearing subterranean formations, are formed within the grout curtain and the drilling of generally horizontal boreholes from the working areas are drilled through the grout curtain into the oil-bearing formations.

Also, in accordance with the method of the present invention, an open oil collection trough means may be excavated within each working area for the collection of oil flowing from all of the generally horizontal boreholes and for conveying the collected oil into the shaft, where it drops into a sump area thereof excavated below a lowest oil-bearing formation from which oil is to be collected.

The shaft and the working areas may be thereafter sealed and oil allowed to flow from the horizontal holes into the trough means and thereafter into the sump from which it is lifted to the earth's surface.

Gas may also be collected within the shaft and removed therefrom as the oil is collected.

It should be appreciated that there is no complex piping or valving arrangement necessary in the method of the present invention for collecting oil or gas. Neither is there any necessity for access to any of the working areas after the boreholes have been drilled and put into operation. Hence, there are no ventilation requirements, and no continual safety inspection necessary, in conjunction with having men and/or manually-operated equipment in the shaft and working areas during oil production.

BRIEF DESCRIPTION OF THE DRAWINGS

The advantages and features of the present invention will appear from the following description considered in conjunction with the accompanying drawings, in which.

DETAILED DESCRIPTION

Figure 1:
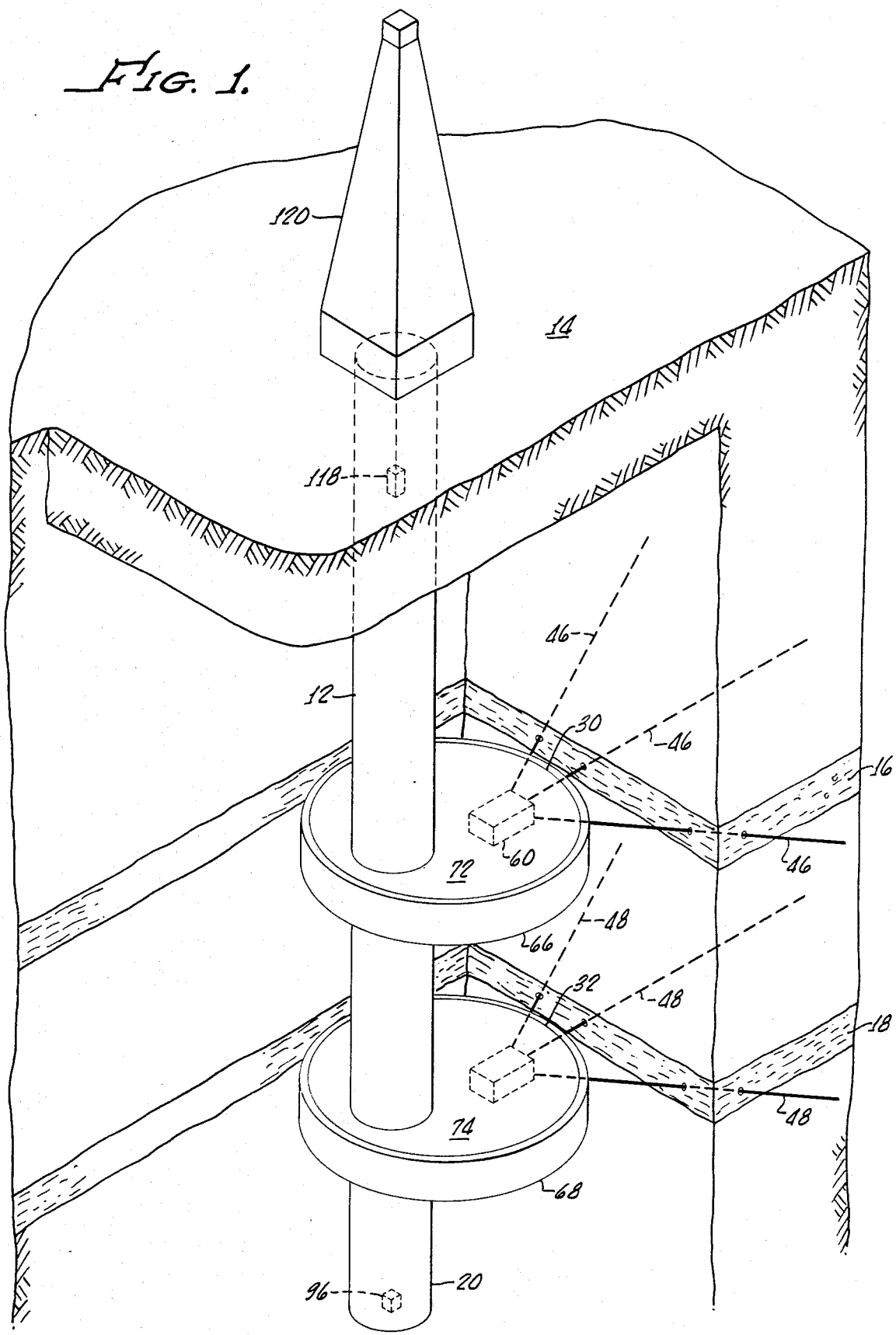
FIG. 1 is a perspective representation of a system excavated, in accordance with the method of the present invention, showing generally in cross-section a plurality of oil-bearing formations, a shaft, a working area at each of the oil-bearing formations, with each working area having an open collection trough, or ring, for the collection of oil; and, FIG. 2 is a cross-sectional representation of a shaft and working area excavated in accordance with the present invention, generally showing working areas excavated within a grout curtain and generally horizontal boreholes drilled within the oil-bearing formations in an upward manner to enable the effect of gravity to enhance the collection of oil and also showing the drilling of horizontal holes into an overlaying oil-bearing formation for the collection of oil if sufficient driving force is present, such as natural gas, to force the oil into the shaft and thereafter into the sump.
Figure 2:
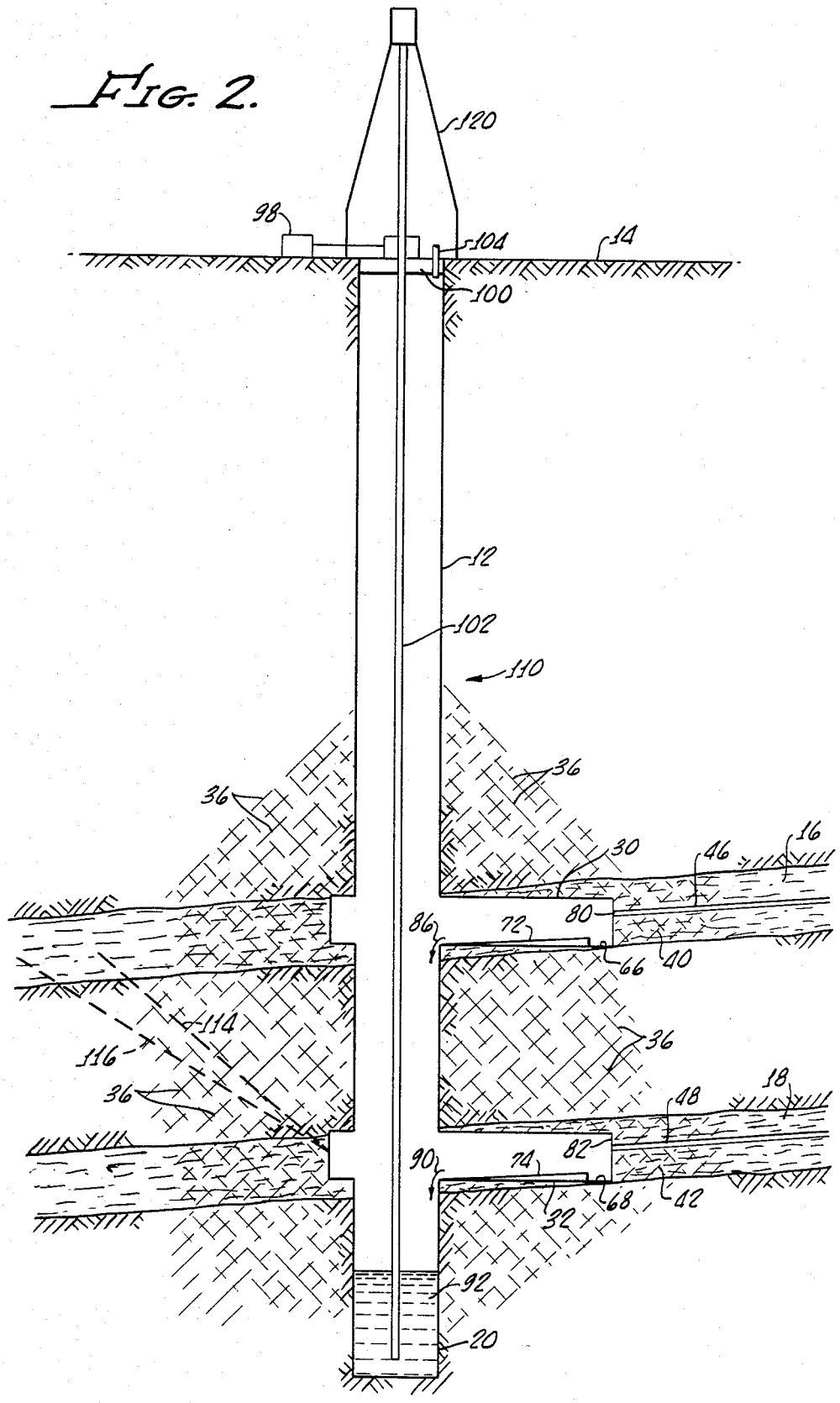

The method, in accordance with the present invention, for collecting oil from a plurality of spaced-apart oil-bearing subterranean formations, is represented in FIGS. 1 and 2.

A shaft 12 may be drilled from the earth's surface 14 to a depth sufficient to intersect a plurality of spaced-apart oil-bearing subterranean formations, or strata, 16, 18 and thereafter, to a depth lower than a lowest oil-bearing formation 18 from which oil is to be collected to form a sump 20. The shaft 12 may be drilled, or excavated, in a manner well known in the art and may have a diameter suitable for the movement of personnel and equipment for the later excavation of working areas 30, 32, as will be hereinafter discussed in greater detail.

It is to be appreciated that, although only two spaced-apart oil-bearing subterranean formations, or strata, 16, 18, are shown in FIGS. 1 and 2, a greater number of such strata may be intersected by the shaft 12, as may be determined by preliminary testing and coring techniques, all well known in the art.

As the shaft 12, during excavation approaches the strata, 16, 18, a number of small diameter grout injecting holes 36, may be drilled through the strata in order to inject grout into such oil-bearing subterranean formations 16, 18, to form a grout curtain 40, 42 within and around each of the oil-bearing subterranean formations 16, 18, to prevent oil, or water, movement from the strata 16, 18, into the shaft, as it is drilled or excavated therethrough. This is more clearly shown in FIG. 2.

The grout injection also solidifies the areas between producing strata 16, 18, to insure competent rock for blasting and excavation.

Following the formation of the grout curtain, the shaft 12 is excavated through the strata 16, 18, and subsequently, the working areas 30, 32, are excavated within the grout curtains 40, 42, with each of the working areas communicating with the shaft 12. As shown in FIG. 1, the working areas 30, 32 may be generally circular in shape to facilitate the drilling of generally horizontal holes 46, 48 therefrom. Such generally horizontal holes may be in radial spaced-apart arrangements, as shown in FIG. 1.

After a working area 30, 32 has been established, equipment, including a drill 60, is lowered and the plurality of generally horizontal boreholes 46, 48, are drilled from each of the working areas 30, 32 through the grout curtains 40, 42 into the oil-bearing subterranean formations 16, 18.

As more clearly shown in FIG. 2, these horizontal holes 46, 48 may be drilled in a gradual upward direction into the strata 16, 18, if the subterranean formations 16, 18 are generally inclined in one direction away from the shaft, as is many times the case. In this manner, draining of the oil therefrom is facilitated by the effects of gravity.

It is to be understood that "horizontal" holes, within the meaning of the present description, means holes that are drilled within the oil-bearing formation 16, 18, in a longitudinal manner generally between the top and the bottom of the formation as opposed to "vertical" holes which means holes drilled in a fashion to intersect the formations 16, 18.

The boreholes 46, 48 may be thereafter lined with a perforated liner, or a short solid stand pipe, which may extend from the working areas 30, 32 into the boreholes 46, 48, a short distance, as is well known in the art, to facilitate the collection of oil therefrom. While an elaborate system of pipes and valves, along with pumps, may be provided (not shown) to connect each of the boreholes to the earth's surface 14 for the removal of oil, it is an important feature of the present invention that no such equipment is necessary.

The method of the present invention provides for the excavation of open oil collection troughs, or channels, 66, 68 in floors 72, 74 of the working areas 30, 32, generally beneath heads 80, 82 of the boreholes 46, 48, and about the perimeter of the working areas 30, 32 for the collection of oil.

The working area floors 72, 74 may be slanted toward the shaft 12 to facilitate movement of the oil thereover, or the troughs 66, 68 may be extended across the floors 72, 74 to the shaft 12 for conveying the collected oil to the shaft.

Oil so collected flows thereafter down the shaft 12, as shown by the arrows 86, 90 and is accumulated in the sump 20, forming a pool 92 of oil therein.

During excavation and drilling, sump pumps 96 may be provided to remove oil and water seeping from the working areas into the shaft to the earth's surface 14 for removal.

However, upon the completion of the shaft excavation, working excavation, and drilling of horizontal holes, the shaft 12 may be sealed, as diagrammatically shown in FIG. 2, by a seal 100 and a pipe 102 extended from the earth's surface 14 into the oil pool 92 through which the oil may be raised, or lifted, from the sump 20 to the earth's surface 14 by a single lift 98.

In addition, a valve, or outlet pipe, 104, may be provided in order to collect gas which may escape from the strata 16, 18, during the collection of oil. If gas pressure in the shaft is allowed to build, it may inhibit the flow of oil into the shaft by equalization of the driving pressure within the strata. Hence, the collection and removal of gas from the shaft 12 enables continued collection of oil as well as the production of gas.

It is apparent from the foregoing description and the figures that the method of the present invention provides a method for collecting oil from a plurality of spaced-apart oil-bearing subterranean formations 16, 18, without the use of elaborate pumps, valves and pumping systems, as is normally expected in underground fluid recovery systems.

A feature of the present invention, therefore, is the recovery of oil from a plurality of spaced-apart oil-bearing formations utilizing a sealed collection system 110, as best shown in FIG. 2, thereby eliminating the ventilation requirements of the system 110, and, importantly, the need for constant safety inspections which are necessitated by the presence of men and equipment in collection systems heretofore utilized.

It should also be appreciated that generally horizontal holes 114, 116, may be drilled from one working area 32 into an overlaying working area 16, or an underlying working area (not shown) depending upon rock formation, rock mechanics and other considerations, which may depend upon the amount of oil present in the formation and the pressure gradient therein, as well as the viscosity of the oil and the porosity of the strata 16, 18.

The method for collecting oil from a plurality of spaced-apart oil-bearing formations, in accordance with the present invention, is effective, because the long generally horizontal boreholes 46, 48 have a great capture influence for collecting oil due to the great exposure of the borehole within the strata 16, 18. The method is also very efficient since a single lift system may be utilized for collection of oil from all levels, thus eliminating a multitude of pumps, valves and pipes present in theretofore developed systems for recovery of oil from underground formations.

Additionally, the method, in accordance with the present invention, is suitable for the recovery of oil from a plurality of spaced-apart oil-bearing subterranean formations from which there is little driving force causing the oil to move from within the formation.

Further, the method, in accordance with the present invention, for removing oil from a plurality of spaced-apart oil-bearing subterranean formations also may utilize the shaft and working areas as a basis for subsequent mining of the strata 16, 18, in which the strata are excavated, utilizing conventional equipment in the working areas 30, 32, and transporting the excavated material to a skip 118, supported by a rig 120, and later separating the oil from the excavated strata 16, 18, in a conventional manner.

Although there has been hereinabove-described a specific method for collecting and recovering oil and gas from a plurality of spaced-apart oil-bearing subterranean formations, in accordance with the invention, for the purposes of illustrating the manner in which the invention may be used to advantage, it should be appreciated that the invention is not limited thereto. Accordingly, any and all modifications, variations or equivalent arrangements, which may occur to those skilled in the art, should be considered to be within the scope of the invention as defined in the appended claims.

What is claimed is:

1. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations;

excavating a working area at selected oil-bearing subterranean formations with each said working area communicating with said shaft;

drilling a plurality of generally horizontal boreholes from each of said working areas into the selected oil-bearing subterranean formations; and, collecting oil from said boreholes and conducting said oil through said working areas and through said shaft to the earth's surface.

2. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations;

excavating a working area at selected oil-bearing subterranean formations with each said working area communicating with said shaft;

drilling a plurality of generally horizontal boreholes from each of said working areas into the selected oil-bearing subterranean formations; and, collecting oil from said boreholes in each spaced-apart oil-bearing subterranean formations and raising said collected oil to the earth's surface using a single lift.

3. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations;

excavating a working area at selected oil-bearing subterranean formations with each said working area communicating with said shaft;

drilling a plurality of generally horizontal boreholes from each of said working areas into the selected oil-bearing subterranean formations;

collecting oil from said boreholes in each spaced-apart oil-bearing subterranean formations;

accumulating the collected oil from each spaced-apart oil subterranean formations; and, raising the accumulated oil to the earth's surface.

4. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations;

injecting grout at selected oil-bearing subterranean formations to form a grout curtain within each selected oil-bearing subterranean formation, said grout curtain sealing said selected oil-bearing subterranean formation to prevent oil movement into said shaft;

excavating a working area at the selected oil-bearing subterranean formations within said grout curtain with each said working area communicating with said shaft;

drilling a plurality of generally horizontal boreholes from each of said working areas through the grout curtain and into one of the oil-bearing subterranean formations; and collecting oil from said boreholes and conducting said oil through said working areas and through said shaft to the earth's surface.

5. The method in accordance with claim 4 further comprising the step of excavating open oil collection trough means within each said working area for collecting oil flowing from all of the generally horizontal boreholes drilled from working area and for conveying the collected oil into the shaft.

6. The method according to claims 1, 2, 3, 4 or 5, further comprising the steps of sealing said shaft during collection of oil from said boreholes.

7. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations, said shaft extending to a depth lower than a lowest oil-bearing formation from which oil is to be collected to form a sump;

injecting grout at selected oil-bearing subterranean formations to form a grout curtain within each selected oil-bearing subterranean formation, said grout curtain sealing said selected oil-bearing subterranean formations to prevent oil movement into said shaft;

excavating a working area at the selected oil-bearing subterranean formations within said grout curtain with each said working area communicating with said shaft;

drilling a plurality of generally horizontal boreholes from each of said working areas through the grout curtain and into one of the selected oil-bearing subterranean formations;

excavating open oil collection trough means within each said working area for collecting oil flowing from all of the generally horizontal boreholes drilled from each working area and for conveying the collected oil into the shaft, said oil thereafter flowing down the shaft and into the sump;

lifting oil from said sump to the earth's surface.

8. The method according to claim 7 wherein the step of drilling generally horizontal boreholes from each of said working area comprises drilling said horizontal boreholes in a gradual upward direction into said oil-bearing subterranean formation to facilitate draining of oil therefrom by gravity.

9. The method according to claim 7 or 8 further comprising the step of sealing said shaft during lifting of oil from the sump to the earth's surface.

10. The method according to claim 9 wherein the step of excavating oil collection trough means includes excavating a channel in the floor of each working area along the perimeter of each working area.

11. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations, said shaft extending to a depth lower than a lowest oil-bearing formation from which oil is to be collected to form a sump;

injecting grout at selected oil-bearing subterranean formations to form a grout curtain within each selected oil-bearing subterranean formation, said grout curtain sealing said selected oil-bearing subterranean formation to prevent oil movement into said shaft;

excavating a working area at the selected oil-bearing subterranean formations within said grout curtain with each said working area communicating with said shaft;

drilling a plurality of generally horizontal boreholes from each of said working areas through the grout curtain and into the selected oil-bearing subterranean formations in a gradual upward direction to facilitate draining of oil therefrom by gravity;

excavating an open oil collection trough in the floor of each working area for collecting oil flowing from all of the generally horizontal boreholes drilled from each working area and for conveying the collected oil into the shaft, said oil thereafter flowing down the shaft and into the sump;

sealing the shaft and working areas; and, lifting oil from said sump to the earth's surface.

12. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations;

excavating a working area at selected oil-bearing subterranean formations with each said working area communicating with said shaft;

drilling a plurality of generally horizontal boreholes from each of said working areas into one of the oil-bearing subterranean formations;

sealing said shaft;

allowing oil to flow from said generally horizontal boreholes into the working areas and shaft; and, lifting oil from said shaft to the earth's surface.

13. The method in accordance with claim 12 further comprising the step of excavating open oil collection trough means within each said working area for collecting oil following from all of the generally horizontal boreholes drilled from working area and for conveying the collected oil into the shaft.

14. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations, said shaft extending to a depth lower than a lowest oil-bearing formation from which oil is to be collected to form a sump;

excavating a working area at selected oil-bearing subterranean formations within each said working area communicating with said shaft;

drilling a plurality of generally horizontal boreholes from each of said working areas into the selected oil-bearing subterranean formations;

excavating an oil collection trough within each said working area for collecting oil flowing from all of the generally horizontal boreholes drilled from each working area and for conveying the collected oil into the shaft;

sealing said shaft to prevent air from entering said working areas and shaft;

allowing oil to flow from said generally horizontal boreholes into the oil collections troughs and thereafter into the shaft and sump; and, lifting oil from said sump to the earth's surface.

15. The method according to claim 14 wherein the step of drilling generally horizontal boreholes from each of said working area comprises drilling said horizontal boreholes in a gradual upward direction into said oil-bearing subterranean formations to facilitate draining of oil therefrom by gravity.

16. The method according to claim 15 wherein the step of excavating oil collection trough within each of said working areas includes excavating a channel in the floor of each working area along the perimeter of each working area.

17. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations;

excavating a working area at selected oil-bearing subterranean formations with each said working area communicating with said shaft;

drilling a plurality of generally horizontal boreholes from each of said working areas into the selected oil-bearing subterranean formations;

collecting oil from said boreholes and conducting said oil through said working areas and through said shaft to the earth's surface;

thereafter excavating said selected oil-bearing formations;

lifting said excavated oil-bearing formation to the earth's surface; and, removing said collecting oil from said excavated oil-bearing formations.

18. A method for collecting oil from a plurality of spaced-apart oil-bearing subterranean formations, said method comprising the steps of:

drilling a shaft from the earth's surface to a depth sufficient to intersect a plurality of spaced-apart oil-bearing subterranean formations;

excavating a working area at selected oil-bearing subterranean formations with each said working area communicating with said shaft;

drilling a plurality of generally horizontal boreholes from each of said working areas into the selected oil-bearing subterranean formations;

sealing said shaft;

allowing oil to flow from said generally horizontal boreholes into the working areas and shaft;

lifting oil from said shaft to the earth's surface;

opening said shaft;

thereafter excavating said selected oil-bearing formations;

lifting said excavated oil-bearing formation to the earth's surface; and, removing and collecting oil from said excavated oil-bearing formations.

19. A method for collecting oil and gas from a plurality of spaced-apart oil-and-gas-bearing subterranean formations, said method comprising the steps of:

drilling a shaft from the earth's surface to a depth sufficient to intersect a plurality of spaced-apart oil-and-gas-bearing subterranean formations, said shaft extending to a depth lower than a lowest oil-and-gas-bearing formation from which oil and gas are to be collected to form a sump;

excavating a working area at selected oil and gas-bearing subterranean formations within each said working area communicating with said shaft;

drilling a plurality of generally horizontal boreholes from each of said working areas into the selected oil-and-gas-bearing subterranean formations;

excavating an oil collection trough within each said working area for collecting oil flowing from all of the generally horizontal boreholes drilled from each working area and for conveying the collected oil into the shaft;

sealing said shaft to prevent air from entering said working areas and shaft and to collect gas from said oil-and-gas-bearing formations;

allowing oil and gas to flow from said generally horizontal boreholes into the oil collection troughs and shaft respectively, and thereafter into the shaft and sump;

lifting oil from said sump to the earth's surface; and, removing gas from said shaft.

20. The method according to claim 19, wherein the step of excavating oil collection trough within each of said working areas includes excavating a channel in the floor of each working area along the perimeter of each working area.

21. A method for collecting oil and gas from a plurality of spaced-apart oil-and-gas-bearing subterranean formations, said method comprising the steps of:

drilling a shaft from the earth's surface to a depth sufficient to intersect a plurality of spaced-apart oil-and-gas-bearing subterranean formations;

excavating a working area at selected oil and gas-bearing subterranean formations with each said working area communicating with said shaft;

drilling a plurality of generally horizontal boreholes from each of said working areas into the selected oil-and-gas-bearing subterranean formations;

sealing said shaft;

allowing oil and gas to flow from said generally horizontal boreholes into the working areas and shaft;

lifting oil from said shaft to the earth's surface;

removing gas from said shaft;

opening said shaft;

thereafter excavating said selected oil-bearing formations;

lifting said excavated oil-bearing formation to the earth's surface; and, removing and collecting oil from said excavated oil-bearing formations.

* * * * *